US007357429B2

(12) United States Patent
Eichenauer

(10) Patent No.: US 7,357,429 B2
(45) Date of Patent: Apr. 15, 2008

(54) SAFETY LOCK

(75) Inventor: Manfred Eichenauer, Bochum (DE)

(73) Assignee: K.A. Schmersal GmbH & Co., Wuppertal (DE)

( * ) Notice: Subject to any disclaimer, the term of this patent is extended or adjusted under 35 U.S.C. 154(b) by 0 days.

(21) Appl. No.: 11/478,967

(22) Filed: Jun. 29, 2006

(65) Prior Publication Data

US 2007/0029813 A1 Feb. 8, 2007

Related U.S. Application Data

(63) Continuation of application No. 10/776,784, filed on Feb. 11, 2004, now abandoned.

(30) Foreign Application Priority Data

Feb. 12, 2003 (DE) ..... 103 05 704

(51) Int. Cl.
*E05C 1/06* (2006.01)
*E05B 15/02* (2006.01)

(52) U.S. Cl. ..... 292/144; 292/251.5; 292/340; 292/341.16; 292/341.17; 70/276

(58) Field of Classification Search ..... 292/144, 292/340, 341.16, 341.17, 251.5, 39, 160; 70/276
See application file for complete search history.

(56) References Cited

U.S. PATENT DOCUMENTS

| | | | | | |
|---|---|---|---|---|---|
| 1,262,435 | A * | 4/1918 | Berg | 292/341.16 |
| 2,039,433 | A * | 5/1936 | McNeill | 70/283 |
| 2,786,701 | A * | 3/1957 | Povlich | 292/144 |
| 3,600,021 | A * | 8/1971 | Hawkins | 292/167 |
| 3,919,869 | A * | 11/1975 | Fromm | 70/263 |
| 4,026,589 | A * | 5/1977 | Hanchett, Jr. | 292/341.16 |
| 4,563,886 | A * | 1/1986 | Kletzmaier et al. | 70/118 |
| 4,595,220 | A * | 6/1986 | Hanchett et al. | 292/341.17 |
| 6,283,514 | B1 * | 9/2001 | Letzel | 292/142 |
| 6,409,083 | B1 * | 6/2002 | Link | 235/449 |
| 6,539,760 | B1 * | 4/2003 | Letzel et al. | 70/276 |
| 2002/0113701 | A1 * | 8/2002 | Turk | 340/542 |

FOREIGN PATENT DOCUMENTS

| | | | |
|---|---|---|---|
| DE | 4034023 | * | 10/1990 |
| DE | 297 03 758 U1 | | 7/1997 |
| DE | 198 00 713 A1 | | 7/1999 |
| EP | 134317 | * | 9/1983 |
| EP | 1 071 214 A1 | | 1/2001 |
| WO | WO 85/03970 | | 9/1985 |

* cited by examiner

*Primary Examiner*—Carlos Lugo
(74) *Attorney, Agent, or Firm*—Patterson, Thuente, Skaar & Christensen, P.A.

(57) ABSTRACT

A safety lock for a closing-off device which can be opened, has an actuating unit with an actuator which is guided in a displaceable manner, and has a locking unit into which the actuator, with the closing-off device closed, can be pushed and can be locked via an electromagnetically actuable, pivotable catch, by way of interengaging engagement surfaces, the actuator has a trigger element and the locking unit has a response element which, with the actuator pushed in, reacts to the trigger element by emitting an electric signal which triggers the locking action, in the case of which the catch can be pivoted about an axis extending parallel to the movement direction of the actuator, and the engagement surfaces of the catch and of the actuator run perpendicularly to the movement direction.

1 Claim, 3 Drawing Sheets

SAFETY LOCK

RELATED APPLICATIONS

This application is a continuation of application Ser. No. 10/776,784 filed Feb. 11, 2004, now abandoned which claims priority to German Application No. 103 05 704.8 filed Feb. 12, 2003.

FILED OF THE INVENTION

The invention relates to a safety lock for a closing-off device like a door, a flap or shutter as used for limiting the access to restricted areas as housings of machines or enclosures of machinery like robots or the like.

DESCRIPTION OF THE RELATED ART

A safety lock for a closing-off device in the form of a door, a flap or shutter or the like is known from published German Patent Application DE 199 34 370 A 1. It comprises an actuator which can be displaced in its longitudinal direction and has a trigger element and a nose. Provided in the housing of a locking unit are a catch, which can be pivoted about an axis transversely to the movement direction of the actuator, and a response element, which responds to the trigger element of the actuator. The catch drops in behind the nose when the actuator is pushed in. Via an electromagnet, the catch can be unlocked, counter to the spring bias of the armature rod of the electromagnet, by means of a lever linkage. This design involves relatively high outlay and only allows small tolerances between the installation of the actuator and the housing of the locking unit.

German utility model DE 201 02 819 U1 discloses a safety lock in the case of which an actuator can be locked by an electromagnetically actuable catch which can be moved transversely to the actuator.

U.S. Pat. No. 6,283,514 81 discloses a safety lock in the case of which an actuator can be displaced via a rack-and-pinion drive, the actuator having a recess into which an electromagnetically actuable catch, which can be moved transversely to the actuator, can drop.

It is known from published German Patent Application DE 40 34 023 A 1 to provide, for pieces of furniture such as cabinet walls, a central locking mechanism which, in each cabinet part, comprises a swivel catch which can be pivoted about an axis and can be actuated centrally via a linkage.

SUMMARY OF THE INVENTION

It is an object of the invention is to provide a safety lock which permits large installation tolerances. It is a further object of the invention to provide a safety lock which allows the closing-off device to consolidate. Still a further object of the invention is to provide a safety lock having a simplified mechanical construction.

Thus it is provided a safety lock for an openable closing-off device, comprising: an actuating unit and a locking unit the actuating unit comprising an actuator which is guided in a displaceable manner and pushable into the locking unit, the actuator, with the closing-off device closed, is lockable therein via an electromagnetically actuable, pivotable catch, by way of interengaging engagement surfaces, wherein the actuator comprises a trigger element, wherein the locking unit comprises a response element which, with the actuator pushed in, reacts to the trigger element by emitting an electric signal which triggers the locking action, wherein the catch is pivotable about an axis extending parallel to the movement direction of the actuator, and wherein the engagement surfaces of the catch and of the actuator run perpendicularly to the movement direction.

Since a catch which can be pivoted about an axis extending parallel to the movement direction of the actuator is provided, the engagement surfaces of the catch and of the actuator running perpendicularly to the movement direction, it is possible to arrange the actuator, or a housing accommodating the same, with very large installation tolerances in relation to the locking unit and to accept corresponding consolidating of the closing-off device. The tolerance may thus be, for example, 50% of the width of the actuator or more. At the same time, it is possible to simplify the mechanical design for actuating the catch.

Further objects, advantages and modifications of the invention can be gathered from the following description and the claims.

BRIEF DESCRIPTION OF THE DRAWINGS

The invention is explained in more detail hereinbelow with reference to an exemplary embodiment illustrated in the attached figures.

DESCRIPTION OF THE PREFERRED EMBODIMENT

Figure 1:
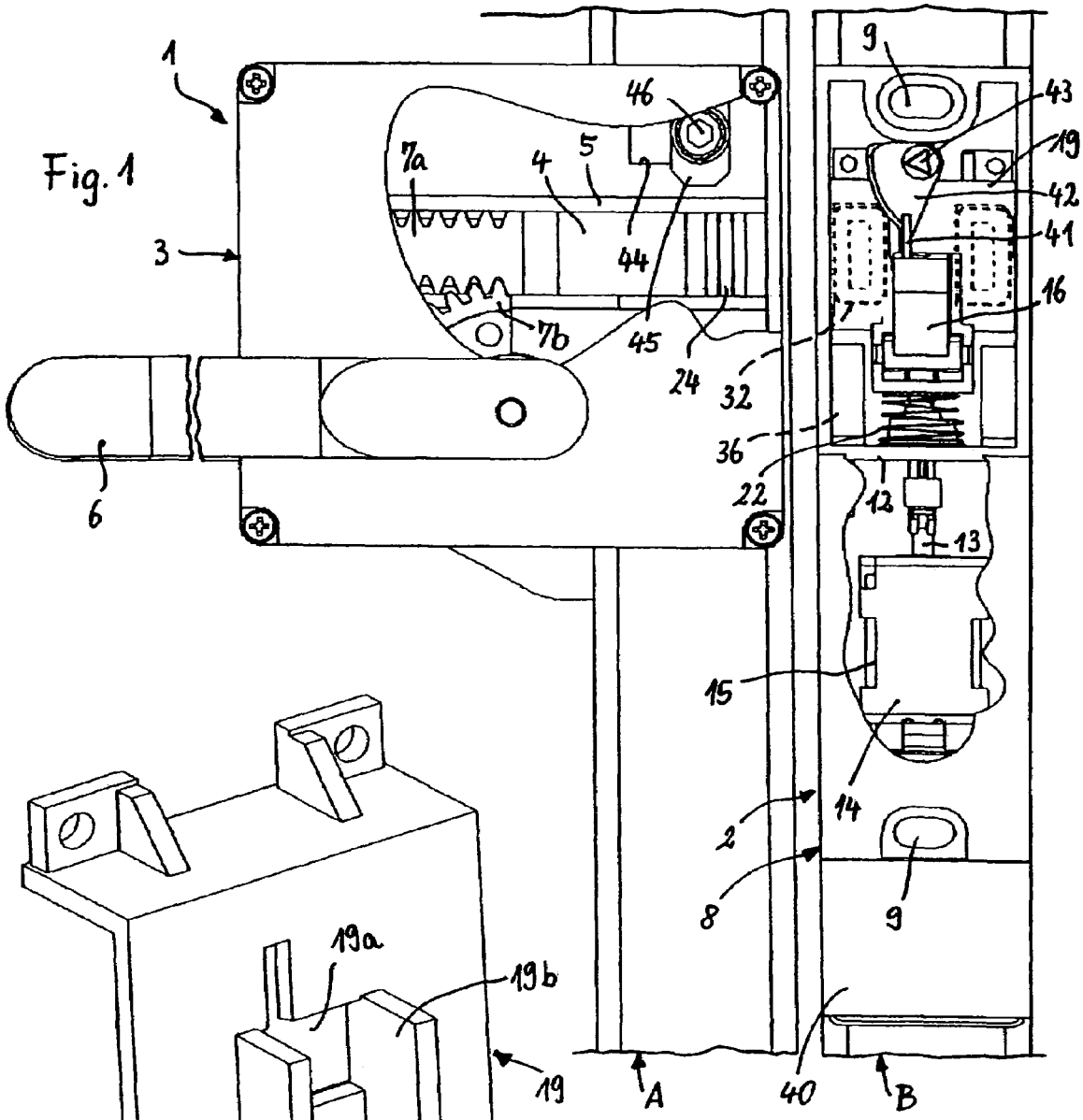
FIG. 1 shows, in partly cut-away form, a front view of one embodiment of a safety lock.

The safety lock which is illustrated in FIG. 1 comprises an actuator unit 1 and a locking unit 2.

The actuator unit 1 comprises a housing 3 which can be closed by means of a cover (illustrated in cut-away form) and is fastened on the openable closing-off device A, for example a door, for instance a sliding or pivoting door, or a flap or shutter or the like. In the housing 3, an actuator 4, which is spring-biased into its starting position, is guided in a displaceable manner in a guide 5. The actuator 4 is displaced, for example, by virtue of a handle 6, which is mounted in the housing 3, being pivoted approximately through 90°, this pivoting movement being converted, via a lever drive or a rack-and-pinion drive 7*a*, 7*b*, into a linear movement of the actuator 4, with the result that the actuator 4 passes out through a slot provided in the housing 3 (this slot not being visible in the illustration of FIG. 1).

The locking unit 2 likewise comprises a housing 8, which can be closed by means of a cover 10 (not illustrated) and can be fastened, via two accommodating openings 9 for fastening screws, on a fixed part 8, on which the open able closing-off device A is provided, for example on a protective grating or a door frame or flap or shutter frame, in particular made of metal profiles or the like. The housing 8 has accommodating openings (not illustrated) for fastening elements, for example screws, for fastening the cover 10. The accommodating openings 9 are expediently designed as slots in the movement direction of the actuator 4, in order to allow corresponding adjustment. Moreover, it is advantageous for the accommodating openings 9 to be arranged in the centre of the longitudinal centre plane of the housing 8 and for at least one accommodating opening 9 to be covered by the cover 10 as protection against manipulation.

The housing 8 has a lateral slot 11 of a height which is considerably greater, e.g. 50% greater, than the height of the actuator 4 and of a width which, in contrast, has relatively little play in relation to the width of the actuator 4. A further, corresponding slot may be provided, in a mirror-symmetrical manner in relation to the slot 11, in the opposite side wall of the housing 8, in order that the locking unit 2 can be utilized both from the right and from the left.

Located adjacent to an intermediate wall 12 in the housing 8 is an electromagnet 15 which has an armature rod 13 and is accommodated, for example, by a holder 14 fastened in the housing 8, the armature rod 13 extending perpendicularly to the movement direction of the actuator 4.

Figure 3:
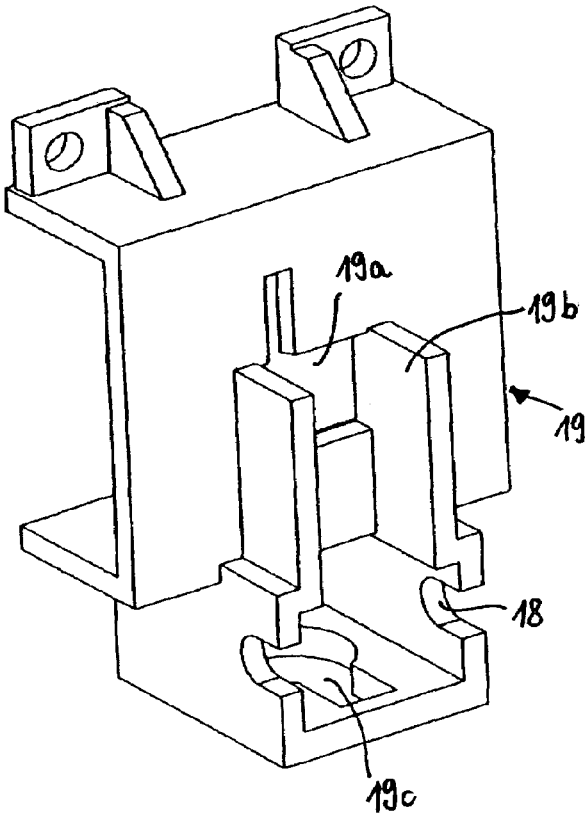
FIG. 3 shows a perspective view of an insert for the safety lock of FIG. 1.

In the housing 8, adjacent to the slot or slots 11, a catch 16 can be pivoted about an axis of rotation extending parallel to the movement direction of the actuator 4. In the case of the exemplary embodiment illustrated, the axis of rotation is formed by two lateral journals 17 of the catch 16, these being accommodated by recesses 18 (illustrated in FIG. 3) of an insert 19 which is inserted, for example screwed, into the housing 8. Instead of this, however, it is also possible for the journals 17 to be mounted in corresponding mounts in the housing 8.

Figure 4:
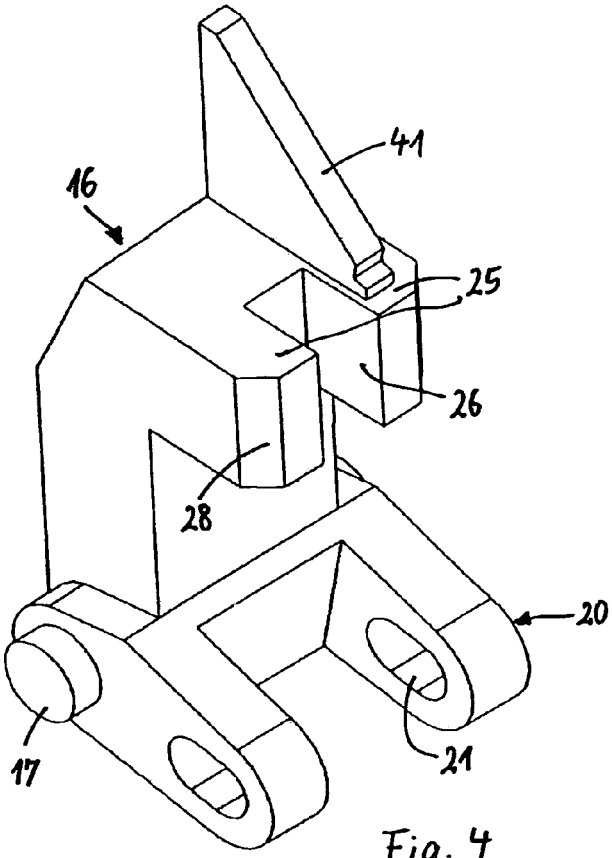
FIG. 4 shows a perspective view of a catch for the safety lock of FIG. 1.
Figure 2:
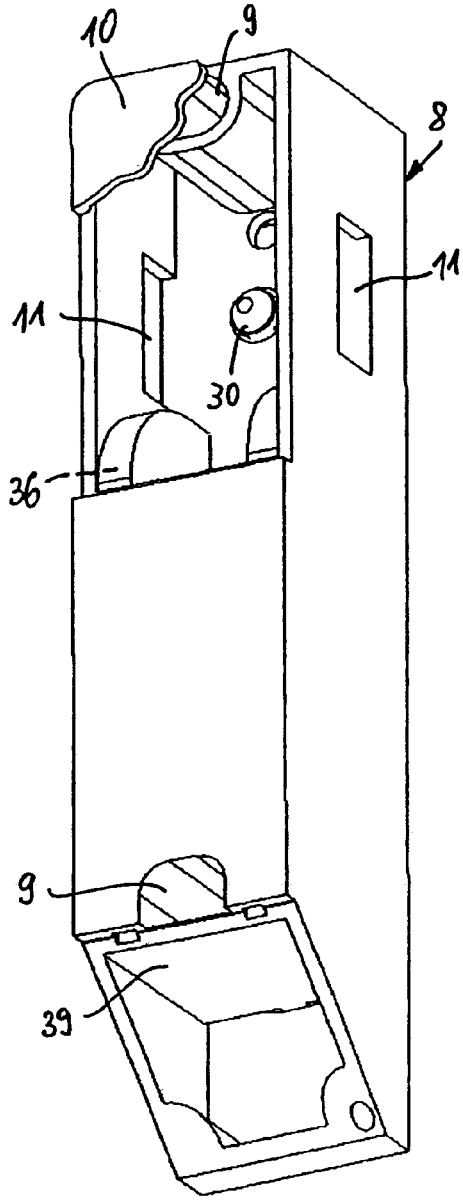
FIG. 2 shows a perspective view of a housing for a locking unit of the safety lock of FIG. 1.

The catch 16 is provided, at the end which is directed towards the electromagnet 15, with a fork 20, see FIG. 4, which is directed towards the actuator 4 and, with accommodating openings 21, is used for a pin which is connected, if appropriate integrally, to the armature rod 13, as a result of which the catch 16 can be pivoted in the manner of an angle lever about the axis of rotation formed by the journals 17 by virtue of the electromagnet 15 being actuated. The armature rod 13 is biased, via a spring 22 (not illustrated), into a position in which it is drawn back into the electromagnet 15. By virtue of the electromagnet 15 being energized, the armature rod 13 is displaced in the direction of the catch 16 and the latter thus pivots. Instead of this quiescent current principle, it is also possible to use the working current principle, in the case of which the electromagnet 15, when energized, retains the catch 16 in the locked position, whereas, in the case of the electromagnet not being energized, the catch 16 is pivoted, under its spring bias, to its unlocking position. Since the linear movement of the armature rod 13 is converted into a pivoting movement, only a small linear displacement of the electromagnet 15 is required for a large pivoting movement of the catch 16.

The actuator 4 has, on the side which is directed towards the catch 16, one or more grooves 23, in the exemplary embodiment illustrated two grooves 23, which are separated from one another by a crosspiece 24. The grooves 23 and the crosspiece 24 extend perpendicularly to the movement direction of the actuator 4 and form engagement surfaces for the catch 16. The latter is provided with corresponding engagement surfaces in the form of protrusions 25, which correspond to the grooves 23 and are separated from one another by a groove 26 corresponding to the crosspiece 24.

With the actuator 4 pushed into the locking unit 2, it is thus possible for the catch 16 to drop in a form-fitting manner, under the bias of the spring 22 acting on the armature rod 13, and to retain the actuator 4 in the locked position. The catch 16 is then released by the electromagnet 15 being energized.

The actuator 4 expediently has a slope 27 which is directed towards the catch 16 and by means of which the catch 16 can be forced back, counter to the spring force acting on it, before it drops into the grooves 23 of the actuator 4.

The grooves 23 expediently slope outwards on the side which is directed away from the crosspiece 24, the protrusions 25 of the catch 16 being of corresponding configuration. As a result, the slope 27 of the actuator 4 runs onto a slope 28 of the corresponding protrusion 25. In the case of the exemplary embodiment illustrated, the catch 16 and actuator 4 are suitable for both right-hand and left-hand use.

Since the protrusions 25 can engage in a locking manner with the grooves 23 anywhere over the length of the latter, the arrangement of the actuator unit 1 in relation to the locking unit 2 within the possible limits is not critical, i.e. these two units may be correspondingly offset in relation to one another in terms of height without the interaction being adversely affected, as long as the actuator 4 can be pushed into the adjacent slot 11.

It is also possible for the engagement surfaces of the actuator 4 and catch 16 to be arranged in a complementary manner in relation to the embodiment depicted.

Figure 5:
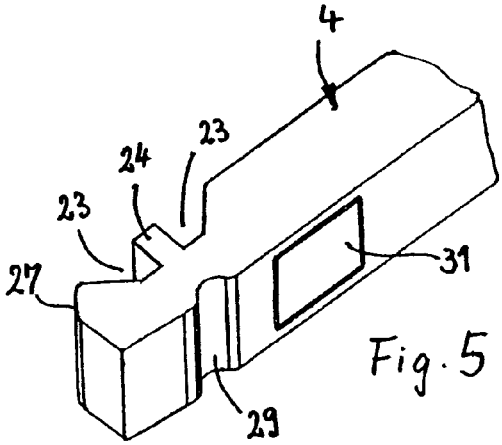
FIG. 5 shows a perspective view of an actuator for the safety lock of FIG. 1.
Figure 6:
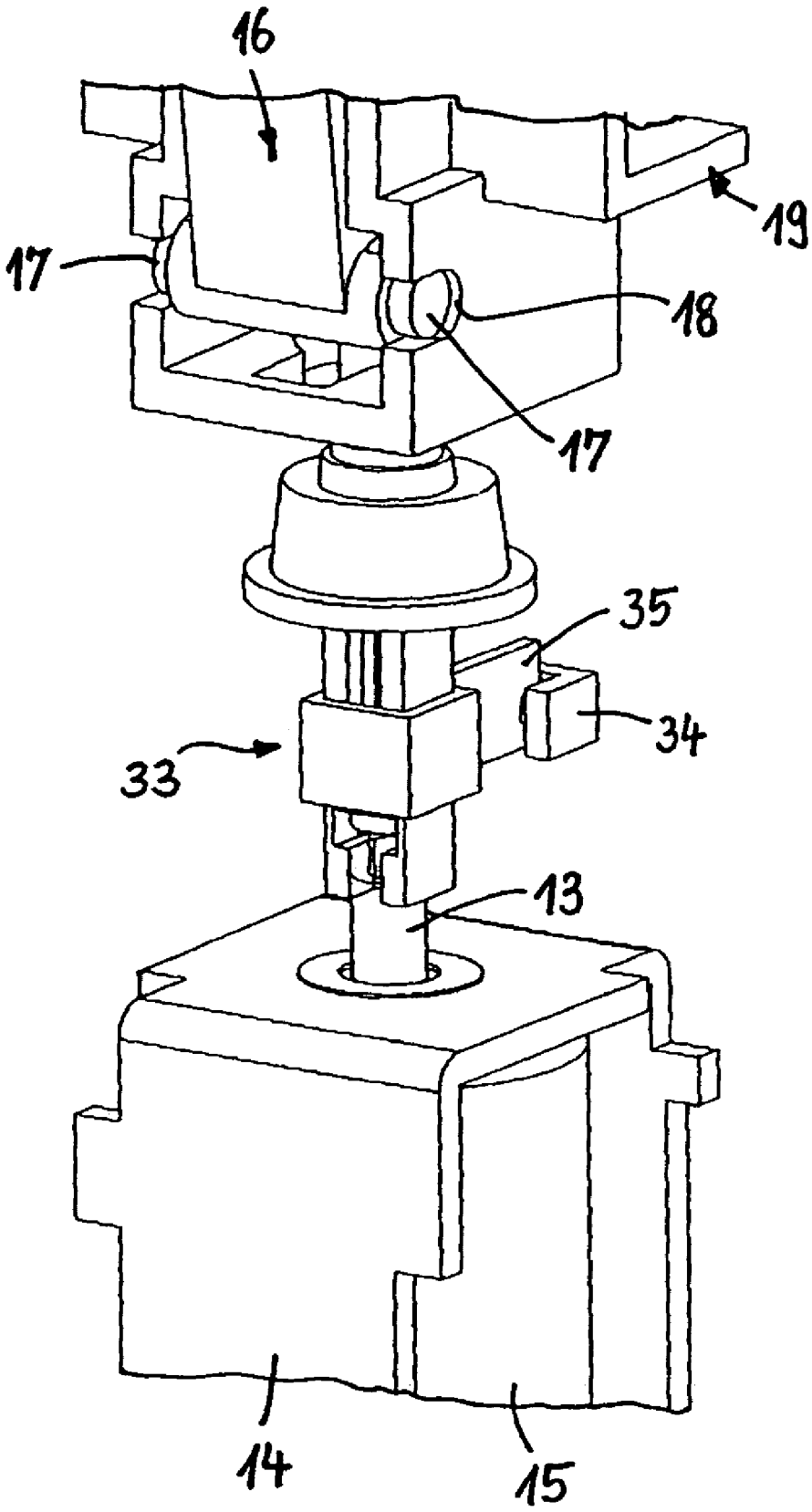
FIG. 6 shows a perspective view of a detail of a locking unit of the safety lock of FIG. 1.

The actuator 4 has, on its side which is directed away from the catch 16, a laterally sloping latching groove 29, see FIG. 5, which runs parallel to the grooves 23 and is arranged centrally in relation to the crosspiece 24. Provided in the housing 8 is a spring-biased latching element 30 (for example a ball or a rounded cylinder) which, with the actuator 4 in an appropriate position, latches into the latching groove 29. This latching acts, on the one hand, as a positioning aid for the actuator 4 and, on the other hand, to free the catch 16 of forces urging it in the movement direction of the actuator 4. The actuator 4 is expediently provided, at its free end, with a slope for displacing the latching element 30 counter to its spring bias.

The actuator 4 has, on its side which is directed away from the catch 16, a recess for accommodating a trigger element 31, which interacts with a corresponding response element 32. It is possible for the trigger element 31 to be, for example, a magnet and for the response element 32 to be a reed switch, although it is also possible for the trigger element 31 to be a resonant circuit or an electronic tag (transpoder) and for the response element 32 to be a coil with an evaluation circuit or else an excitation and evaluation circuit which is suitable for an electronic tag. A check is thus made as to whether the actuator 4, and possibly the correct actuator 4, has been introduced into the housing 8 of the locking unit 2, and a corresponding electric signal is generated.

The response element 32 is to be selected to be large enough for it always to be capable of reliably intercepting the trigger element 31.

If the intention is for the locking unit 2 to be usable both for a right-hand and for a left-hand actuating unit 1, two response elements 32 are provided.

In addition, it is desirable to monitor the position of the catch 16 by means of a corresponding sensor device 33. In the exemplary embodiment illustrated, the latter is formed by a fork-type light-barrier arrangement which comprises at least one fork-type light barrier 34, as is illustrated, or two fork-type light barriers 34, fixed parallel to one another in the housing 8, while the armature rod 13, connected in a rotationally fixed manner thereto, bears a paddle 35 which moves, by way of the armature rod 13, in the corresponding opening of the fork-type light barrier 34 and has a light-passage opening for each fork-type light barrier 34. It is only when the catch 16 has dropped into the actuator 4 that light shines through the light-passage opening and a corresponding signal is emitted.

It is also possible, for the purpose of monitoring the presence of the actuator unit 1 and thus of the closing-off device in the closed position, to provide a trigger element (not visible) on the housing 3 of the actuator unit 1 and, in the housing 8 of the locking unit 2, a sufficiently large response element 36 (the latter preferably being provided on the right-hand and the left-hand sides). These may be designed like the elements 31, 32. This provides an additional safeguard and identifies whether the closing-off device is still open or closed.

The insert 19 forms a channel with a cross section corresponding to the shape of the slots 11 for the introduction of the actuator 4, and has an open rear side, with the result that the latching element 30 can engage with the actuator 4, and, opposite, a recess 19*a* for the catch 16, the recess being bounded by two side walls 19*b*, and, on the base side, an opening 19*c* for the through-passage of the armature rod 13.

It is possible for the wall located opposite the cover 10 of the housing 8 to be designed as a printed circuit board and to bear the response elements 32, the fork-type light barriers 34, a terminal 37 for an electric cable fed through a base opening 38, etc.

The housing 8 is expediently bevelled in the rearward direction at the bottom, in which -case the housing section which is bounded by the bevelling, on the one hand, is separated off from the rest of the housing interior by an intermediate wall 39 and, on the other hand, can be closed by an additional cover 40 which is triangular in side view, with the result that the closed housing 8 is cuboidal overall. In the sloping space covered by the cover 40, it is possible to arrange terminals, for example in the manner of a terminal strip, these being easily accessible on account of the bevelling of the housing 8, with the result that the cores of a feeder cable (not illustrated) can easily be connected.

The catch 16 may bear a triangular nose 41, which can be utilized in order to make mechanical unlocking possible following removal of the cover 10, for example in that a tool is correspondingly attached or else a locking element 42, which acts on the nose 41 and thus on the catch 16, widens in a curved manner and is mounted rotatably in the housing 8, is correspondingly rotated, for example by means of a tool plugged into a polygonal opening 43. On account of its spring bias, the actuator 4 is then moved back into the housing 3. The recess 19*a* in the insert 19 opens out, as can be seen from FIG. 3, in a slot for the nose 41.

In order for it to be possible to bridge various openings between the parts A, B, for example door openings, it is expedient if the housing 3 has horizontal slots 44 which accommodate sliding blocks 45, which can be fastened on the part A by means of screws 46. By virtue of the housing 3 being displaced in relation to the sliding blocks 45 retained on the part A, the housing 3 can be moved into the desired adjustment position, whereupon the screws 46 are tightened.

Although the foregoing has been a description of preferred embodiments of the invention, it will be apparent to those skilled in the art that numerous variations and modifications may be made in the invention without departing from the scope as described herein.

What is claimed is:

1. A safety lock for an openable closing-off device, comprising:

an actuating unit and a locking unit;

the actuating unit comprising an actuator which is guided in a displaceable manner and pushable into the locking unit, the actuator, with the closing-off device closed, is lockable therein via an electromagnetically actuable, pivotable catch, by way of interengaging engagement surfaces;

wherein the actuator comprises a trigger element;

wherein the locking unit comprises a response element which, with the actuator pushed in, reacts to the trigger element by emitting an electric signal which triggers the locking action;

wherein the catch is pivotable about an axis extending parallel to the movement direction of the actuator;

wherein the engagement surfaces of the catch and of the actuator run perpendicularly to the movement direction and the engagement surfaces of the catch are provided on a lateral side of the catch in the direction of its latching pivotization; and wherein the locking unit has an insert which is inserted into its housing, in which the catch is mounted in a pivotable manner and which forms a channel for the actuator.

* * * * *